US005090497A

United States Patent [19]

Beimgraben et al.

[11] Patent Number: 5,090,497

[45] Date of Patent: Feb. 25, 1992

[54] FLEXIBLE COUPLING FOR PROGRESSIVE CAVITY DOWNHOLE DRILLING MOTOR

[75] Inventors: Herb Beimgraben, Houston; Benny Melton, Woodlands; Jay Eppink, Spring; Paul Reinhardt, Houston, all of Tex.

[73] Assignee: Baker Hughes Incorporated, Houston, Tex.

[21] Appl. No.: 758,406

[22] Filed: Aug. 30, 1991

Related U.S. Application Data

[63] Continuation of Ser. No. 560,379, Jul. 30, 1990, abandoned.

[51] Int. Cl.[5] ..... E21B 4/00

[52] U.S. Cl. ..... 175/107; 418/48

[58] Field of Search ..... 175/92, 101, 107; 418/48

[56] References Cited

U.S. PATENT DOCUMENTS

| | | | |
|---|---|---|---|
| 2,346,426 | 4/1944 | Hait | 418/182 |
| 2,621,605 | 12/1952 | Mark, Jr. . | |
| 3,133,603 | 5/1964 | Lagacherig et al. | 175/107 |
| 3,155,187 | 9/1960 | De Lorean . | |
| 3,600,113 | 8/1971 | Pahl et al. | 418/48 |
| 3,840,080 | 10/1974 | Berryman | 175/107 |
| 3,938,744 | 2/1976 | Allen | 414/48 X |
| 4,080,115 | 3/1978 | Sims et al. | 175/107 X |
| 4,397,619 | 8/1983 | Alliquander et al. | 175/107 X |
| 4,452,322 | 6/1984 | Jurgens | 175/107 |
| 4,485,880 | 12/1984 | Makohl | 175/107 |
| 4,636,151 | 1/1987 | Eppink | 418/48 |
| 4,679,638 | 7/1987 | Eppink | 175/107 |
| 4,764,094 | 8/1988 | Baldenko et al. | 418/48 X |
| 4,854,401 | 8/1989 | Kruger et al. | 175/107 |
| 4,909,337 | 5/1990 | Kochnev et al. | 175/107 |

FOREIGN PATENT DOCUMENTS

| | | |
|---|---|---|
| 2945858 | 3/1980 | Fed. Rep. of Germany . |
| 2084697 | 4/1982 | United Kingdom . |

*Primary Examiner*—Ramon S. Britts
*Assistant Examiner*—Roger J. Schoeppel
*Attorney, Agent, or Firm*—Price, Gess & Ubell

[57] ABSTRACT

A composite flexible torsion bar coupling is used to connect the orbiting rotor of a Moineau-type motor to the concentrically rotating output drive shaft. The two-piece torsion bar coupling is hollow, to allow fluid passage through the rotor. This permits large quantities of fluid flow through the bit without passing all the fluid through the motor. The torsion bar is connected to the rotor at an inside surface adjacent to a power-producing surface of the rotor. This configuration provides the shortest possible coupling distance, thereby considerably reducing the overall length of the motor without decreasing its power output.

20 Claims, 2 Drawing Sheets

FLEXIBLE COUPLING FOR PROGRESSIVE CAVITY DOWNHOLE DRILLING MOTOR

This is a continuation of application Ser. No. 560,379, abandoned filed on July 30, 1990, for a Flexible Coupling for Progressive Cavity Downhole Drilling Motor.

BACKGROUND OF THE INVENTION

1. Field of the Invention

The present invention relates generally to improvements in downhole drilling motors of the progressive cavity type and, more particularly, pertains to a new improved flexible coupling means between the stator of such a motor and its power output shaft.

2. Description of Related Art

Downhole drilling motors have been used for many years in the drilling of oil and gas wells, for example. In the usual mode of operation, the power output shaft of the motor and the drill bit will rotate with respect to the housing of the motor. The housing, in turn, is connected to a conventional drill string composed of drill collars and sections of drill pipe. This drill string extends to the surface where it is connected to a kelly, mounted to the rotary table of a drilling rig. Drilling fluid is pumped down through the drill string to the bottom of the hole and back up the annulus between the drill string and the wall of the bore hole. The drilling fluid cools the drilling tools and removes the cuttings resulting from the drilling operation. In the instances where the downhole drilling motor is a hydraulic type, such as a progressive cavity type motor, the drilling fluid also supplies the hydraulic power to operate the motor.

Progressive cavity type hydraulic motors are also known as Moineau motors. These hydraulic motors are well known in the art. They have a helical rotor within the cavity of a stator which is connected to the housing of the motor. As the drilling fluid is pumped down through the motor, the fluid rotates the rotor. As the helical rotor rotates, it also gyrates or orbits in the reverse direction relative to its rotation. Some type of universal connection must be used to connect the gyrating rotor to the nongyrating output shaft of the motor. A typical connector utilizes a pair of universal joints which connect a straight rod to the rotor and to the shaft. The universal sections are designed to take only torsional load. A ball and race assembly is used to take thrust load. Rubber boots are clamped over the universal sections to keep drilling fluid out of the ball race assembly. Most assemblies of this type also require oil reservoir systems to lubricate the ball race and universal joints. If the rubber boots loosen or come off, allowing drilling fluid to enter and wear out the ball race assembly, the universal joints are forced to take the torsional and thrust loads, causing premature failure.

Other prior art methods have contemplated the use of long flexible shafts to connect the rotor to the motor output shaft. These shafts flex sufficiently to compensate for the gyration of the rotor. However, in order to provide for sufficient flex, the shafts have to be quite long. As a result, the overall length of the motor becomes excessive. An attempt to overcome this problem is presented in U.S. Pat. No. 4,636,151, issued Jan. 13, 1987 to Jay M. Eppink and assigned to Hughes Tool Company. The invention contemplated in this patent is directed to a connecting rod that has sufficient flexibility without being excessively long.

However, a need still exists to provide for a coupling means which is even shorter than that possible by use of the Eppink invention, and which is even more flexible, so as to permit placement of a bend in the motor housing between its rotor-stator section and the power output shaft section. Such bent housing motors are finding increasing use in steerable directional drilling systems. Such systems are becoming increasingly more important in the field of oil and gas exploration and recovery.

SUMMARY OF THE INVENTION

The orbiting motion of the rotor of a drilling motor is coupled to the concentric rotation of the output drive shaft by a torsion bar that connects inside the rotor adjacent to a power-producing surface. The torsion bar is hollow to allow fluid passage through the rotor as well as between the rotor-stator.

BRIEF DESCRIPTION OF THE DRAWINGS

The exact nature of this invention, as well as its objects and advantages, will be readily appreciated as they become better understood by reference to the following detailed description, when considered in conjunction with the accompanying drawings, in which like reference numerals designate like parts throughout the figures and wherein.

DESCRIPTION OF THE PREFERRED EMBODIMENTS

Figure 1:
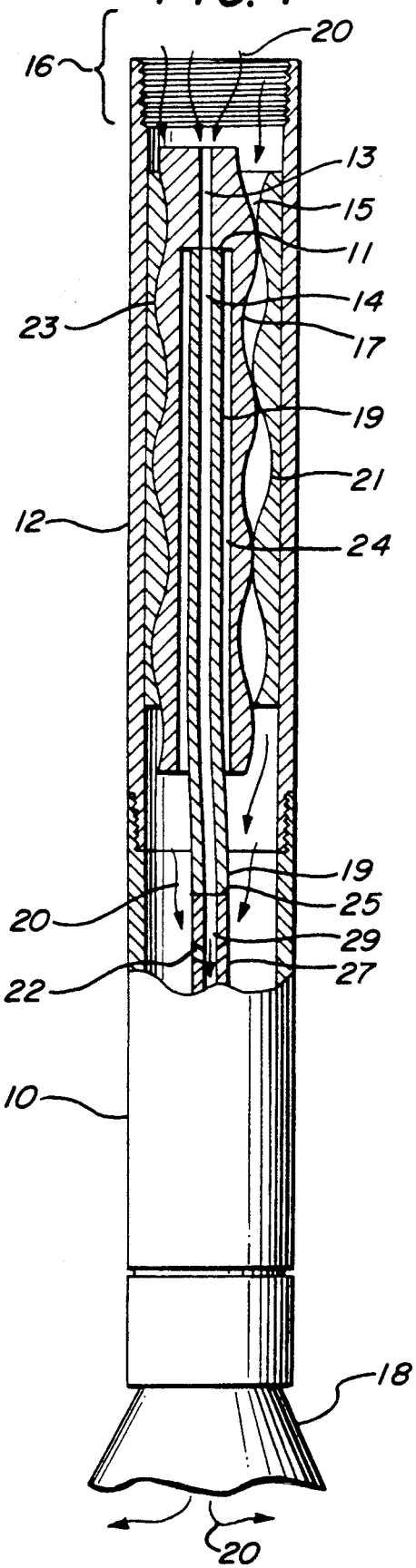
FIG. 1 is a broken-away partial section of a drilling motor showing the coupling mechanism of the present invention.

FIG. 1 illustrates in partial section the two major sections of a Moineau motor which relates to the present invention. The rotor-stator section 12 is illustrated in partial section. The bearing section 10 within which power output shaft 27 rotates is shown in diagrammatic form. Not illustrated is the bypass-dump valve section 16, which is connected to the top of the rotor-stator section 12. The bypass-dump section is, in turn, connected to the drill string. At the bottom end of the bearing section 10 a bit 18 is connected to the power output shaft 27. The bit 18 is illustrated in diagrammatic form. A more complete illustration of a Moineau motor of the type shown in FIG. 1 can be found in U.S. Pat. No. 4,636,151.

The Moineau motor of FIG. 1 is powered by drilling fluid 20 which is pumped down the drill string (not shown) into the rotor-stator section 12 of the motor, causing the rotor 17 to rotate, turn, and gyrate within stator 21. Stator 21 is attached to the housing of rotor-stator section 12. This housing, in turn, threadably attaches to the bypass valve 16 above it (not shown) and threadably attaches to the bearing section 10 below it. Traditionally, Moineau motors of this type have an additional section for the connecting rod assembly, as is shown in U.S. Pat. No. 4,636,151. Because of the present invention, however, the connecting rod assembly section has been virtually eliminated in that the connecting rod 19 has become part of the rotor 17.

The rotor 17 is preferably made of a chromium material. The stator 21, on the other hand, is a hard rubber composite. The rotor has a large bore 24 extending from the end facing the bearing section 10 through its center to the top, ending at some distance 11 from the bottom of rotor 17. The connecting rod 19 is located within this bore and fastened to the rotor at the top 11 of the bore. The attachment point 11 is preferably near the top of rotor 17 to allow the torque and motion of rotor 17 to be transferred to the motor output shaft 27. The coupling rod 19 must not only rotate, but flex to accommodate the lateral orbiting motion of rotor 17 within stator 21 as the drilling fluid 20 passes through cavities 15 between rotor 17 and stator 21.

Once the drilling fluid has passed through the rotor-stator section, it will enter the hollow power output shaft 27 through apertures 22 in the sides of the shaft. The drilling fluid will pass through channel 29 in output shaft 27 to the bit 18, flow through the bit and out the bottom end.

The length of the rotor 17 and stator 21 and, specifically, the complementary surface area 23 between the two, is known as the power-producing surface of the rotor-stator unit. The size of this surface has a direct effect on the power output of the Moineau motor. By attaching connecting rod 19 to the rotor 17 adjacent to a power-producing surface of the rotor-stator combination, such as point 11, the connecting rod section is considerably reduced in length. This reduces the overall length of the Moineau motor without affecting the power-producing surface 23 of the motor and its power output.

Another feature of the present invention is the provision of a Moineau rotor 17, which has a bore 13 along its axis along its length. A first bore 13 opens up into a second bore 24, which is larger in diameter in order to accommodate the connecting rod 19. Connecting rod 19 also has a bore 14 along its axis which is sized to mate with bore 13 in rotor 17. When connecting rod 19 is attached to rotor 17 adjacent to a power-producing surface at point 11, for example, bore 13 will mate with bore 14 of the connecting rod 19 to pass drilling fluid 20 through the center of rotor 17 directly to the bore 29 in power output shaft 27. Connecting rod 19 connects with output shaft 27 at their respective ends 25 in a manner that causes bore 14 to mate with channel 29.

The amount of drilling fluid 20 that is directed through the rotor, through bore 13 and bore 14 of the connecting rod 19, is preferably controlled by an orifice (not shown) which may be located inside bore 13 of the rotor 17 or above it, as convenient. The ability to pass drilling fluid through the rotor, thereby bypassing the normal path 15 between the rotor and stator, is of great advantage in those instances when it is desired to cause large quantities of drilling fluid to flow through the bit without letting that same amount of fluid flow past the rotor-stator power-producing surface. This arrangement will allow greater control over the speed of the motor and, in turn, the bit, while still permitting large quantities of drilling fluid to flow through the bit.

Figure 2:
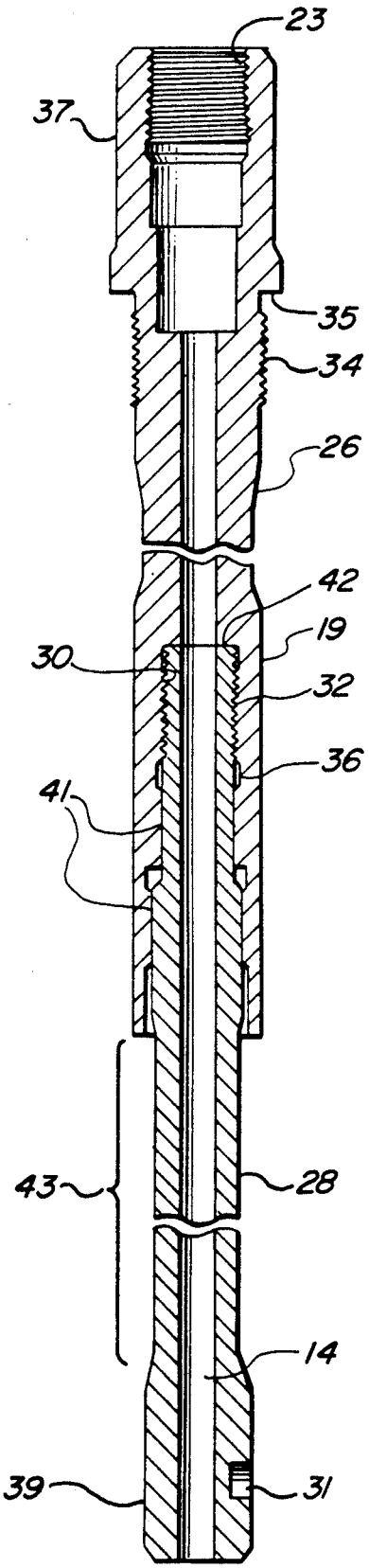
FIG. 2 is a side view in section of the connecting rod of the present invention.

The preferred construction of the connecting rod 19 of the present invention is shown in FIG. 2. Connecting rod 19 is a composite flexible rod having two component sections, an upper section 26 and a lower section 28. The lower section 28 inserts into and attaches to upper section 26 inside bore 36 at the lower end of upper section 26. Upper section 26 is preferably made of a high strength steel. Lower section 28 is preferably made of a strong but flexible material such as titanium. The lower section 28 has a threaded end 30 that threadably attaches to upper section 26 by internal threads 32 located in bore 36. In order to substantially reduce or eliminate stress on the threads 30-32, the portion of the lower section 28 that fits within bore 36 of upper section 26 is interference fitted within bore 36 specifically in the area 41 immediately below the threaded connection 30-32. This interference fit is accomplished by heating the lower portion of the steel upper section 26. While upper section 26 is at an elevated temperature, the lower section 28 is screwed down until its shoulder abuts the upper end 42 of bore 36. When upper section 26 cools down, it will shrink slightly to create an interference fit at area 41 with lower section 28.

Lower section 28 is shaped to have a smaller diameter along a portion of its length 43 in order to channel the bending forces to this area and away from the connecting threads 30-32. The bottom part 39 of lower section 28 again has a larger diameter than bending area 43. This bottom area will connect to the power output shaft 27 (FIG. 1), in a manner which will be explained hereinafter.

The upper end 37 of composite flex rod 19 is shaped to accommodate an internal threaded area 23 for attachment to a bypass valve assembly section, for example. In addition, the upper section 26 has another external threaded area 34 with a shoulder 35 which, as will be explained in connection with FIG. 3, is utilized to attach to rotor 17.

Figure 3:
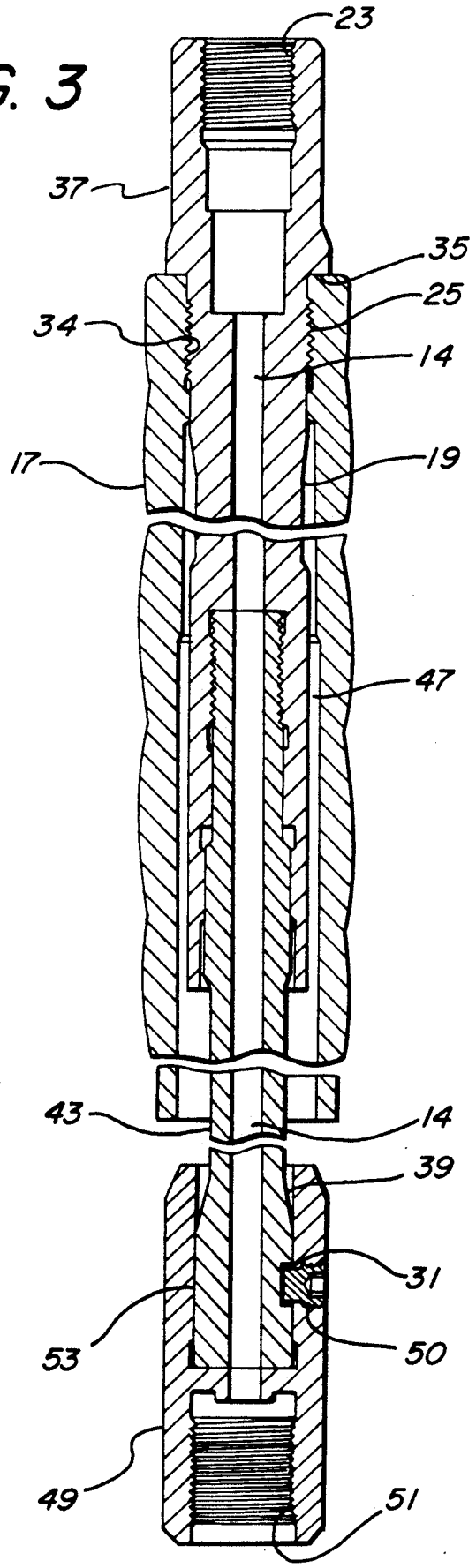
FIG. 3 is a side view in section of the connecting rod of the present invention located inside the rotor of a Moineau motor.

Referring now to FIG. 3, the rotor 17 is shown having a large bore 47 along its axis from one end to the other. This bore is sized to accommodate the upper section of the composite flex rod 19. The external threads 34 on the upper section of the composite flex rod 19 engage the internal threads 25 in bore 47 of the rotor. The rotor is torqued tight so that the upper end of rotor 17 abuts shoulder 35 of the top portion 37 of flex rod 19. The lower end 39 of composite flex rod 19 is attached to a connection mechanism 49 by a press fit and pin arrangement.

Connection mechanism 49 has a set of internal threads 51 which receive external threads (not shown) of the motor output shaft so that the bore 14 of composite flex rod 19 engages with the channel 29 (FIG. 1) in the power output shaft. Connecting mechanism 49 is pinned to the end section 39 of composite rod 19 by a set screw 50 which threadably engages connecting mechanism 49 and sets into a slot 31 in end section 39. The fastening of set screw 50 into slot 31 of end section 39 is done while connecting mechanism 49 has been elevated to a higher temperature. After it is allowed to cool, the contact surface 53 between the internal cavity in connecting mechanism 49 and the end section 39 of composite rod 19 will have an interference fit relationship.

What has been described is a tie rod mechanism which not only considerably reduces the overall length of a Moineau motor without decreasing its power output, but also allows the passing of drilling fluid through the center of the rotor section, thereby allowing increased drilling fluid flow at the bit without affecting the motor speed.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. In combination with a downhole drilling motor having a progressive cavity stator and a rotor rotating and gyrating within the stator in response to fluid flow through the stator wherein a housing connected to the stator contains a shaft mounted within the housing for rotation about the longitudinal axis of the shaft, the improvement therein comprising:

a flexible rod having an upper end and a lower end, said rod being connected to said rotor at its upper end, and connected to said shaft at its lower end for translating the rotation and gyration of said rotor to the axial or true rotation of said shaft, said rod comprising a composite assembly of an upper section and a lower section, said upper section having external threads along a predetermined distance of its length, said rotor being hollow with internal threads, fitting over said upper section and threadably engaging the external threads of said upper section, said lower section including a threaded connection means at the lower end of said lower section for connecting said flexible rod to said shaft, said upper section being made of steel and said lower section being made of titanium.

2. In combination with a downhole drilling motor having a progressive cavity stator and a rotor rotating and gyrating within the stator in response to fluid flow through the stator wherein a housing connected to the stator contains a shaft mounted within the housing for rotation about the longitudinal axis of the shaft, the improvement therein comprising:

a flexible rod having an upper end a lower end, said rod being connected to said rotor at its upper end, and connected to said shaft at its lower end for translating the rotation and gyration of said rotor to the true rotation of said shaft, said rod having an internal bore along its entire length from upper end to lower end, said bore mating with an internal bore in said rotor at its upper end and with an internal bore in said shaft at its lower end, said flexible rod comprising a composite assembly of an upper section and a lower section, said upper section being made of steel and said lower section being made of titanium.

3. In combination with a downhole drilling motor having a progressive cavity stator and a rotor rotation and gyrating with the stator in response to fluid flow through the stator wherein a housing connected to the stator contains a shaft mounted within the housing for rotation about the longitudinal axis of the shaft, the improvement therein comprising:

a flexible rod having an upper end and a lower end, said rod being connected to said rotor at its upper end, and connected to said shaft at its lower end for translating the rotation and gyration of said rotor to the axial or true rotation of said shaft, said rod being a composite assembly of an upper section and a lower section, wherein said upper section is made of steel and said lower section is made of titanium.

4. In combination with a downhole drilling motor. having a progressive cavity stator and a rotor rotating and gyrating within the stator in response to fluid flow through the stator wherein a housing connected to the stator contains a shaft mounted within the housing for rotation about the longitudinal axis of the shaft, the improvement therein comprising:

a flexible rod having an upper end and a lower end, said rod being a composite assembly of an upper section and a lower section, said lower section being attached to said upper section inside said rotor adjacent to a power-producing surface of said rotor, said rod being connected to said rotor at its upper end, and connected to said shaft at its lower end for translating the rotation and gyration of said rotor to the axial or true rotation of said shaft.

5. The improved combination of claim 4 wherein said upper section has an upper end and a lower end, the lower end of said upper section having a bore along the axis of the upper section, with internal threads located in said bore.

6. The improved combination of claim 5 wherein the upper end of said lower section has an interference fit within the bore at an area below the internal threads.

7. The improved combination of claim 6 wherein said lower section has a reduced diameter for a predetermined distance along its length.

8. The improved combination of claim 7 further comprising a threaded connection means, nonintegral to, but connected to the lower end of said lower section for connecting said flexible rod to said shaft.

9. The improved combination of claim 8 wherein said upper section has external threads along a predetermined distance of its length; and wherein said rotor is hollow with internal threads and fits over said upper section, threadably engaging the external threads of said upper section.

10. The improved combination of claim 4 wherein said upper section has external threads along a predetermined distance of its length; and wherein said rotor is hollow with internal threads and fits over said upper section, threadably engaging the external threads of said upper section.

11. The improved combination of claim 10 further comprising a threaded connection means, nonintegral to, but connected to the lower end of said lower section for connecting said flexible rod to said shaft.

12. In combination with a downhole drilling motor having a progressive cavity stator and a rotor rotating and gyrating within the stator in response to fluid flow through the stator wherein a housing connected to the stator contains a shaft mounted within the housing for rotation about the longitudinal axis of the shaft, the improvement therein comprising:

a flexible rod having an upper end and a lower end, said rod being connected to said rotor at its upper end, and connected to said shaft at its lower end for translating the rotation and gyration of said rotor to the true rotation of said shaft, said rod having an internal bore along its entire length from upper end to lower end, said bore mating with an internal bore in said rotor at its upper end and with an internal bore in said shaft at its lower end, said flexible rod comprising a composite assembly of an upper section and a lower section; said lower section being attached to said upper section inside said rotor adjacent to a power-producing surface of said rotor.

13. The improved combination of claim 12 wherein said upper section has external threads for a predetermined distance along its length; and wherein said rotor is hollow with internal threads for a predetermined distance, said rotor fitting over said upper section and threadably engaging the external threads of said upper section.

14. The improved combination of claim 13 wherein said upper section is made of steel and said lower section is made of titanium.

15. The improved combination of claim 12 wherein said lower section has an upper end and a lower end and the upper end threadably engages said upper section.

16. The improved combination of claim 15 wherein said upper section has an upper end and a lower end, the lower end of said upper section having integral threads and an enlarged bore.

17. The improved combination of claim 16 wherein, the upper end of said lower section has an interference fit with the bore in the lower end of said upper section at an area below the internal threads.

18. The improved combination of claim 17 wherein said lower section has a reduced diameter for a predetermined distance along its length.

19. The improved combination of claim 18 further comprising a threaded connection means, nonintegral to, but connected to the lower end of said lower section for connecting said flexible rod to said shaft.

20. The improved combination of claim 19 wherein said upper section has external threads for a predetermined distance along its length; and wherein said rotor is hollow with internal threads for a predetermined distance, said rotor fitting over said upper section and threadably engaging the external threads of said upper section.

* * * * *